US006352967B1

(12) United States Patent
Irwin

(10) Patent No.: US 6,352,967 B1
(45) Date of Patent: Mar. 5, 2002

(54) ADDITIVES FOR IMPROVING ACID REACTIVITY AND METHOD FOR CONTROLLING ACID REACTIONS

(76) Inventor: David W. Irwin, 13236 Richards Dr., Strongsville, OH (US) 44136

( * ) Notice: Subject to any disclaimer, the term of this patent is extended or adjusted under 35 U.S.C. 154(b) by 0 days.

(21) Appl. No.: 09/356,832

(22) Filed: Jul. 19, 1999

(51) Int. Cl.[7] ..... C11D 7/08; C11D 7/10

(52) U.S. Cl. ..... 510/258; 510/245; 510/247; 510/253; 510/269; 134/3; 134/41

(58) Field of Search ..... 134/3, 41, 28; 510/245, 247, 253, 258, 269

(56) References Cited

U.S. PATENT DOCUMENTS 2,636,009 A 4/1953 Irwin ..... 252/146
2,692,187 A 10/1954 Chester et al. ..... 41/42
2,692,188 A 10/1954 Chester et al. ..... 41/42
2,831,814 A 4/1958 Chester et al. ..... 252/148
3,226,180 A 12/1965 Irwin ..... 21/2.5
3,595,799 A 7/1971 Peterson ..... 252/137
4,132,568 A * 1/1979 Irwin ..... 134/3

* cited by examiner

*Primary Examiner*—Charles Boyer
(74) *Attorney, Agent, or Firm*—Joseph H. Taddeo

(57) ABSTRACT

A composition for treating a mineral acid using with a blend of sodium thiosulfate, sodium sulfite and trisodium phosphate. This formulation enhances the corrosion properties of a mineral acid to produce a superior acid reaction when measured in terms of corrosiveness or in terms of the time required to react with a chemical base or alkaline compound.

22 Claims, No Drawings

ADDITIVES FOR IMPROVING ACID REACTIVITY AND METHOD FOR CONTROLLING ACID REACTIONS

FIELD OF INVENTION

The present invention relates to an additives that enhance mineral acid reactions to produce superior acidic reactions, more particularly, to additives that are not limited to pickling metallic surfaces, but have useful application for increased corrosiveness, reduced reaction time with a base and acid reactions with other non-metallic materials.

BACKGROUND OF THE INVENTION

The term "pickling" is commonly referred to as an acidic solution that is used for the treatment of metallic surfaces to remove metal oxides or scale. Strong acids, such as hydrochloric, nitric, or sulfonic acid are used either individually or in combination to cleanse or to brighten the surfaces of articles that are made of metal by processes such as casting, forging, flat rolling, extruding, etc.

In one typical application, a pickling bath is used to cleanse a flat rolled steel sheet of its oxide coating by immersing it in an aqueous acidic solution prior to applying a protective coating of tin by a hot dipping process. Other coating processes such as electroplating, electrodeposition, spraying, etc. require prior surface cleaning and conditioning of metallic substrates.

A detailed study of previous art reveals that no prior art considers or even mentions the added use of a depolarizer in a pickling acid additive formulation. Depolarizers are used in electroplating processes to remove undesirable by-products that are formed at the substrate solution interface that significantly inhibit or stop the electroplating reaction.

U.S. Pat. No. 4,132,568, granted Jan. 2, 1979, to D. W. Irwin, discloses an additive to a pickling acid bath to increase its effectiveness when conditioning the surface of a metal being treated. Sodium sulfite is added to the blend to enhance and to stabilize the formation of colloidal sulfite from sodium thiosulfate.

U.S. Pat. No. 3,595,799, granted Jul. 27, 1971, to J. C. Peterson, discloses a picking additive composition, which when added to an acid picking bath, reduces the acid consumption by at least 25%.

U.S. Pat. No. 3,226,180, granted Dec. 28, 1965, to J. T. Irwin, teaches a process for conditioning metal surfaces in an acid pickling bath, containing preferably sodium thiosulfate, capable of releasing colloidal sulfur and an organic picking acid inhibitor, diorthotolythiourea.

U.S. Pat. No. 2,831,814, granted Apr. 22, 1958, to A. E. Chester and J. T. Irwin, relates of an acid pickling bath, used for the surface treatment of ferrous metals, containing a compound, sodium thiosulfate and a water soluble ionizable ferrocyanide, preferably sodium ferrocyanide. The sodium thiosulfate is capable of releasing colloidal sulfur.

U.S. Pat. No. 2,692,188, granted Oct. 19, 1954, to A. E. Chester and J. T. Irwin, discloses an acid pickling composition and method of picking steel, containing a compound, sodium thiosulfate, that is capable of releasing colloidal sulfur and a water soluble ionizable inhibitor, sodium thiosulfate, to produce a microfine etch.

U.S. Pat. No. 2,692,187, granted Oct. 19, 1954, to A. E. Chester and J. T. Irwin, discloses an acid pickling composition and method of pickling steel containing a compound, sodium thiosulfate, that is capable of releasing colloidal sulfur and a water soluble chromic inhibitor, chromium aldonate, to produce a microfine etch for better adherence of other electrodeposited metals.

U.S. Pat. No. 2,636,009, granted Apr. 21, 1953, to J. T. Irwin, relates to the conditioning of metal surfaces where the pickling acid bath is comprised predominantly of sulfuric acid, with 1 to 8 parts of sodium thiosulfate per seven hundred parts of seven percent of sulfuric acid.

The use of sodium thiosulfate and sodium sulfite is not new, having been previously disclosed. Additives to mineral acids in the form of inhibitors to retard corrosion rates or in the form of protective coatings to prevent corrosion are common. Additives in the form of wetting systems, sophisticated or simpler are also used in manufacturing processes using mineral acid to wet out the acid or form a blanket of foam to hold down dangerous acid fumes. These various chemicals can be added at the point of manufacture or to the manufacturing process involving the acid.

However, the use of sodium thiosulfate for treatment of a mineral acid to improve quality thereof by directly adding the thiosulfate to a commercial grade of acid imparts a significant problem. The sodium thiosulfate will breakdown into an undesirable cloud of sulfur when directly added to the commercial grade acid.

It is therefore an object of the present invention to add in small, incremental doses, a blend of sodium thiosulfate and a depolarizer, trisodium phosphate, ranging from 0.01% to 5% by weight of acid, to change the properties of a mineral acid making it more active in its ability to react with and dissolve certain metals, oxides, and salts.

It is another object of the present invention to use a blend of sodium salts and phosphates at various delivery points to change the properties of a mineral acid, thereby enhancing its ability to react with oxides, bases, or alkali's to form salts.

It is still another object of the present invention to use a blend of sodium salts and phosphates to modify the properties of a mineral acid, so that it will corrode metal at a faster rate.

It is still yet another object of the present invention to use a blend of sodium salts and phosphates to modify the properties of a mineral acid, that once modified by using the formulation herein disclosed, will react with various salts at a faster rate.

These and other objects and advantages of the present invention will be better appreciated and understood upon reading the following detailed description of the formulation described herein as the presently preferred embodiment.

SUMMARY OF THE INVENTION

The present invention relates to enhancing the reactivity of an inorganic acid, commonly referred to as mineral acid or acid salt, by adding a novel formulation of sodium thiosulfate, sodium sulfite, and trisodium phosphate. This novel formulation enhances the corrosion properties of a mineral acid to produce a superior acid reaction when measured in terms of corrosiveness or reactivity of the substrate.

This invention incorporates the known acid enhancing compounds, sodium thiosulfate and sodium sulfite, with trisodium phosphate as a direct addition to the mineral acid at any one of several delivery points to change the properties of that mineral acid making it more active as a means of reacting with and dissolving certain metals, salts, and oxides.

Such treatment of an acid using the formulation of the present invention may take place after the manufacture of an acid, in storage, or prior to shipment to the end user; to a mineral acid which has been processed through an acid recovery system, or to a mineral acid as it is being used in a manufacturing process.

An inorganic acid is often referred to as being a mineral acid. The two major types of mineral acid that are most often used are sulfuric and hydrochloric acid. Each mineral acid has it own unique properties and is blended in various commercial grades for industrial consumption.

By itself, mineral acid of a known concentration will exhibit reactivity or corrosive properties with various metals, salts, and oxides that can be measured and compared with the objects of the present invention.

The following examples illustrate that a mineral acid can be so modified to corrode metal at a faster rate and that a mineral acid once modified by using the concepts herein disclosed will react with a base at a faster rate. The examples that follow will show reactions of the sodium thiosulfate and trisodium phosphate in a mineral acid singly and in combination to better illustrate the advantages of the present invention.

DETAILED DESCRIPTION OF THE PREFERRED EMBODIMENT

The pickling additive of the preferred embodiment of the present invention is comprised of the following formula relationship. The formula relationship of sodium thiosulfate to trisodium phosphate to sodium sulfite ranges from 0.1% wt. to 20% wt. sodium thiosulfate to 0.001% wt to 10% wt trisodium phosphate to 0.02% wt. to 4% wt. sodium sulfite, and the remainder, water. Other combinations within the ranges of these chemicals may be employed to maximize the effect of the acid reaction but for purposes of illustration a typical additive, Blend A, to be blended with an acid such as sulfuric or hydrochloric, but not limited to these mineral acid's would be: 10.0% wt. trisodium phosphate, 9.0% wt. sodium thiosulfate, 0.5% wt. sodium sulfite and 80.5% wt. water.

In an alternative composition Blend B additive is preferably 14% wt. sodium thiosulfate, 1.4% wt. sodium sulfite, 1% wt. trisodium phosphate and the balance, water. Blend B contains a 30% wt. reduction in sodium thiosulfate, yet the reaction times are faster when compared to that of trisodium phosphate alone or sodium thiosulfate/sodium sulfite alone.

This invention is further illustrated in the following examples.

EXAMPLES

The following examples illustrate the corrosive properties of a mineral acid by comparing the time that it takes to remove a mill oxide from the surface of a steel specimen.

One prominent feature of a mineral acid is its ability to react with the oxide found on a steel surface and to dissolve that oxide from the surface. The tests that follow were performed under the following conditions. Contiguous pieces of 10B21 rod were cut from a steel coil that had an annealing oxide on its ice.

EXAMPLE I

The purpose of the test in the first example is to demonstrate the enhancing effect the additive components have with hydrochloric acid in removing annealing oxides from a steel surface at a controlled temperature of 70° F.

Conditions: HCl acid 18% wt.; steel rod 10B21 grade; ambient temperature; annealing scale
Results: Corrosiveness as Time to Remove Oxide

| 18% HCl | 18% HCl Trisodium Phosphate | 18% HCl Sodium Thiosulfate | 18% HCl Trisodium Phosphate Sodium Thiosulfate |
|---|---|---|---|
| 45.7 min. | 50.0 min. | 28.5 min. | 23.7 min. |

The above results demonstrate that the trisodium phosphate is functioning as a depolarizer that enhances the descaling reaction time of hydrochloric acid when used in conjunction with a blend of thiosulfate, since the trisodium phosphate alone with hydrochloric acid showed no improvement in the descaling time.

EXAMPLE II

The second example illustrates the effectiveness of combining the additives in Example I with hydrochloric acid at differing temperatures.

Conditions: HCl acid 18% wt.; 1008 C steel rod; various temperature; mill scale
Results: Corrosiveness as Time to Remove Oxide

| Temp. | 18% HCl | Sodium Thiosulfate | Trisodium Phosphate Sodium Thiosulfate |
|---|---|---|---|
| 32.2° C. | 11.0 min. | 5.5 min. | 4.0 min. |
| 37.77° C. | 7.5 min. | 4.0 min. | 3.0 min. |
| 43.33° C. | 4.0 min. | — | — |

The data above shows that the mill scale is removed at a faster rate as the temperature is increased in all cases. These results demonstrate that not only does the trisodium phosphate enhance the descaling reaction, it is also energy efficient allowing for increased reactivity at lower temperatures.

EXAMPLE III

The third example illustrates a reaction with the sulfuric acid and 10B21 grade steel rod where mass loss was observed for a fixed immersion the of from ½ to ⅟₁ minutes at 160° F. The following table shows the comparison of the superior reaction obtained by the further addition of trisodium phosphate to the sodium thiosulfate additive in sulfuric acid.

Conditions: $H_2SO_4$ acid 7%/wt.; enameling iron; 160° F.
Results: Corrosiveness as Weight Loss/$Ft^2$ of steel

| $H_2SO_4$ 7% acid Dose | Sodium Thiosulfate 0.03%/v | Sodium Thiosulfate Trisodium Phosphate 0.03%/v |
|---|---|---|
| 0.3432 gms. per $Ft^2$ | 1.0476 gms. per $Ft^2$ | 1.776 gms. per $Ft^2$ |

EXAMPLE IV

The final example best illustrates each of the objects of the preferred embodiment singly and in combination when compared to a mineral acid reaction in terms of the relative time to remove a mill oxide.

The following is a comparison of the recorded time to remove mill scale from C1008 coupons that were sheared from the same sheet and that were cut contiguous to each other.

As a control, a test strip was placed in an acid solution of 17%/wt. HCl and 0.3% /vol. of the HCl of commercial inhibitor A, which was run at 84 degrees C.

a 35%/wt HCl to which had been added 0.142%/volume of Naxid X additive, a trisodium phosphate based accelerator, then diluted to 170%/wt, 0.3% of the acid volume as inhibitor A then added to the acid solution and run at 82 degrees C.;

a 35%/wt HCl to which was added 0.05%/vol. Naxid B, a sodium thiosulfate based accelerator, then diluted to a 17%/wt HCl, 0.3%vol. of the HCl as commercial inhibitor A added to the solution and run at 82 degrees C.;

a 35%/wt HCl to which had been added 0.05%/vol. solution Naxid C, an accelerator containing both trisodium phosphate and sodium thiosulfate, then diluted to 17%/wt HCl, plus 0.3%/vol. of the HCl as commercial inhibitor A and run at 82 degrees C.

The solutions were first placed in a beaker, then placed in a temperature controlled water bath at 82 degrees C. or 84 degrees C. The time to remove the mill oxide was recorded.

| Time to pickle mill scale in seconds | | |
|---|---|---|
| Control<br>1:1 HCl<br>0.3% Inhibitor A<br>84 degrees C. | Naxid B<br>1:1 HCl<br>0.3% Inhibitor A<br>0.025%/vol. HCl<br>82 degrees C. | Naxid C<br>1:1 HCl<br>0.3% Inhibitor A<br>0.025%/vol. HCl<br>82 degrees C. |
| 33.75 sec. | 32.67 sec. | 29.75 sec. |

The Naxid X is an additive which can be added to either sulfuric acid at 60 and 66 Baume strengths and to hydrochloric acid in its three commercial strengths of 18, 20 and 22 degree Baume, such percentages being formula weight. I have found this additive provides increased effectiveness of mineral acids at 9.5% wt trisodium phosphate, 1.0% wt sodium thiosulfate, 0.2% sodium sulfite, 89.3% water.

The Naxid B additive includes 20% sodium thiosulfate, 2% sodium sulfite, and the balance water, for enhancing effective corrosiveness of the composition while minimizing reaction time at the lowest practical temperature.

Naxid C is preferably 14% sodium thiosulfate, 1.4% sodium sulfite, 1% trisodium phosphate and the balance, water.

The Naxid C is 30% weaker than Naxid B in sodium thiosulfate yet the reaction times are faster when compared to that of trisodium phosphate alone or sodium thiosulfate/sodium sulfite alone by simply replacing the 30 percent difference of sodium thiosulfate with 1% of trisodium phosphate. Early studies using sodium thiosulfate in a diluted acid solution indicated that the maximum rate of scale removal was when the sodium thiosulfate was at 1:2000/vol. of the acid volume, the same ratio as the Naxid B and Naxid C examples. However, in the Naxid C example, the presence of sodium thiosulfate is well below that was previously taught indicating a synergistic effect between the sodium thiosulfate and the trisodium phosphate has taken place.

The use of the Naxid additives is more remarkable when considering that the temperature is two degrees C colder, about 5 degrees F. in the Naxid examples. Reaction of an acid to an oxide is like many chemical reactions, the time to complete the reaction is affected by concentration and temperature. In this instance the concentration of the acid remained constant but the temperature was reduced. However, the time to complete the reaction was quicker than that of a higher temperature which had none of the additives of the present invention.

While the invention has been disclosed and described in some detail in the foregoing description, the descriptions are to be considered illustrative, as other modifications and deviations may suggest themselves to those skilled in the art and within the broad scope of the invention, with reference to the appended claims. Additionally, the scope of its application is not limited to the pickling of metallic surfaces only.

I claim:

1. An aqueous pickling composition comprising:

a mineral acid with an acid additive to control a reactivity of the acid, minimize colloid formations and increase effectiveness of the acid;

wherein the additive is a blend of sulfur liberating and colloidal refining components to hasten acid reactions with metal oxides, inorganic and organic salts, the blend formed by the steps of mixing sodium sulfite, sodium thiosulfate and trisodium phosphate in incremental doses and said composition formed by the step of introducing the blend into the acid in minute incremental doses, thereby avoiding production of an undesirable cloud of sulfur.

2. The composition of claim 1, wherein the sodium sulfite is in a range from 0.02% to 4% by weight of the blend and the balance is a solvent.

3. The composition of claim 2, wherein the sodium thiosulfate is in a range from 0.1% to 20% by weight of the blend and the balance is a solvent.

4. The composition of claim 3, wherein the trisodium phosphate exists in a range from 0.001% to 15% by weight of the blend and the balance is a solvent, for a further control of the acid reactivity in dissolving metal oxides at a faster rate.

5. The composition of claim 4, wherein the minute doses of the blend are added in a range from 0.01% to 5% by weight of the acid.

6. The composition of claim 5, wherein the mineral acid of the solution comprises up to 98% by weight of the solution and the balance is water.

7. The composition of claim 6, wherein the mineral acid comprises hydrochloric acid in a range from 5% to 36% by weight and the balance is water.

8. The composition of claim 6, wherein the mineral acid comprises sulfuric acid having a consequent enhanced reactivity by introduction of the blend into the acid, compared to the acid alone or the acid combined with any one of the blend components.

9. The composition of claim 8, wherein the sulfuric acid ranges from 5% to 25% by weight and the balance is water.

10. The composition of claim 1, wherein the blend exists in a ratio of sodium thiosulfate to trisodium phosphate to sodium sulfite ranging from 0.1% wt to 20% wt sodium thiosulfate to 0.001% wt to 10% wt trisodium phosphate to 0.02% wt to 4% wt sodium sulfite with a balance of water.

11. The composition of claim 1, wherein the blend comprises 9.0% wt sodium thiosulfate, 10.0% wt trisodium phosphate and 0.5% wt sodium sulfite and the balance is water, and enhances effective removal of metal oxides, organic and inorganic salts while minimizing reaction time at the lowest practical temperature.

12. The composition of claim 1, wherein the blend comprises 14.0% sodium thiosulfate, 1.0% trisodium phosphate and 1.4% sodium sulfite by weight and the balance water, wherein the addition of the blend allows for corrosion of metals at a faster rate and increases an acid/base reactivity.

13. The composition of claim 1, wherein the sodium thiosulfate added to the blend is 0.03% of an acid volume, allowing for further increase in corrosiveness of the composition.

14. The composition of claim 1, wherein the trisodium phosphate and sodium thiosulfate are added to the blend in a dose rate of 0.03% per volume of acid, allowing for an optimum increase in corrosiveness of the composition.

15. The composition of claim 1, wherein the trisodium phosphate and sodium thiosulfate are added to the blend in a dose rate, of 0.06% per volume of acid.

16. An aqueous pickling composition according to claim 1, wherein the additive blend is added to the mineral acid at a dose rate of 0.001% to 3% of an acid volume.

17. A method of using the aqueous pickling solution of claim 1 to remove coatings and scale formations from a metallic material, comprising the steps of:

providing a mineral acid solution containing up to 98% acid by wt;

adding a blend including sodium thiosulfate, trisodium phosphate and sodium sulfite, to the solution to enhance corrosion properties of the mineral acid; and, providing a metallic material which will corrode in the mineral acid solution;

contacting the metallic material with the solution for the purpose of corrosive removal of said coatings and scale formations from the metallic material.

18. The method of claim 17, wherein the blend is added to the mineral acid solution in small incremental doses.

19. The method of claim 18, further comprising the step of:

controlling the mineral acid solution temperature.

20. The method of claim 19, wherein the mineral acid solution temperature is controlled to less than 110° C.

21. A method for making the composition of claim 1, comprising the steps of:

providing a mineral acid solution containing up to 98% acid by weight;

adding to the solution an acid additive that includes sodium thiosulfate, trisodium phosphate and sodium sulfite.

22. A process for using the composition of claim 1 for scale removal from sheet steel in a controlled acid reaction, comprising the steps of:

providing sheet steel having a mill scale; and, treating the sheet steel with the composition of claim 1 for removal of the mill scale.

* * * * *